US008048286B2

(12) United States Patent
Jagannathan et al.

(10) Patent No.: US 8,048,286 B2
(45) Date of Patent: Nov. 1, 2011

(54) ALUMINUM REDUCTION CELL FUSE TECHNOLOGY

(75) Inventors: Ramaswamy Jagannathan, Chhattishgarh (IN); Divakaran Paranantham, Chhattishgarh (IN)

(73) Assignee: Bharat Aluminum Company Limited, Chhattishgarh (IN)

( * ) Notice: Subject to any disclaimer, the term of this patent is extended or adjusted under 35 U.S.C. 154(b) by 1106 days.

(21) Appl. No.: 11/776,127

(22) Filed: Jul. 11, 2007

(65) Prior Publication Data

US 2008/0029403 A1 Feb. 7, 2008

(51) Int. Cl.

| | |
|---|---|
| ***C25C 5/00*** | (2006.01) |
| ***C25C 3/06*** | (2006.01) |
| ***C25C 1/00*** | (2006.01) |
| ***C25C 7/00*** | (2006.01) |

(52) U.S. Cl. ..... 205/345; 205/363

(58) Field of Classification Search ..... 204/244, 204/253, 267; 205/345, 363

See application file for complete search history.

(56) References Cited

U.S. PATENT DOCUMENTS

| | | | | |
|---|---|---|---|---|
| 4,683,047 | A * | 7/1987 | Boivin et al. | 204/244 |
| 4,696,730 | A * | 9/1987 | Chaffy et al. | 204/244 |
| 6,551,473 | B1 * | 4/2003 | Gaillard et al. | 204/244 |

* cited by examiner

*Primary Examiner* — Harry D Wilkins, III
*Assistant Examiner* — Zulmariam Mendez
(74) *Attorney, Agent, or Firm* — Rader, Fishman & Grauer, PLLC

(57) ABSTRACT

A method of taking inoperative pot online using fuse in an aluminium manufacturing plant operating on electrolysis process is disclosed. The manufacturing plant comprises of plurality of electrolysis cells or pots connected in series. Some of the pots are kept off line during start up of the plant by shorting the risers of the non running pots to the cathode bus bar (31) by shorted joints (II). The method comprises, connecting fuse assemblies in parallel with the shorted joints; inserting insulating insert plates between the risers and the short circuit bus bars and securing the insulating insert plates to isolate the short circuit bus bars from the risers (14) such that the total rated current passes through the fuse assemblies. The fuse elements in the fuse assemblies melt within about 8 to 10 minutes, completely isolating the short circuit bus bars from the risers such that the risers now feed the current to the anode assemblies of the non running pot. Feeding of charge to the non running pot is the started, thus taking the non running pot on line.

6 Claims, 8 Drawing Sheets

ALUMINUM REDUCTION CELL FUSE TECHNOLOGY

CROSS-REFERENCE TO RELATED APPLICATIONS

This application claims priority from Indian Patent Application Serial No. 1102/MUM/2006 filed Jul. 11, 2006, the disclosure of which, including the specification, drawings and claims, is incorporated herein by reference in its entirety.

FIELD OF INVENTION

The present disclosure relates generally to manufacturing metals from their intermediate compounds or ores by an electrolysis process. More particularly, the present disclosure relates to manufacturing of aluminium from intermediate compounds such as, for example, alumina.

BACKGROUND

Aluminium has many useful properties. Accordingly, it is second in production, after iron and steel. Because the density of aluminium is low, it is used for forming many strong alloys that contain relatively small percentages of silicon, copper, manganese, magnesium, and zinc. These alloys, with their light weight and high strength, are preferred for use in many industries like automotive, consumer durables, utensils etc. The thermal conductivity and the electrical conductivity is the third highest; just lower than silver and copper. Aluminium is also non-magnetic. Thus, its high ductility makes it available in rolled, extruded, forged, drawn forms. Aluminium may be easily machined and its low melting point makes it suitable for casting and superior quality die castings. It is commercially available in forms such as plates, sheet, and bars, rolled sections, pipes, wire, and foil. Aluminium is highly resistant to corrosion under usual conditions in the atmosphere and in water.

Owing to these useful properties, worldwide aluminium manufacturing capacity in the year 2000 was approximately 20 million metric ton/yr and it is still growing with the demand.

Aluminium is manufactured from the intermediate compound e.g. alumina, which is obtained from the ores like bauxite, available in the earth crust. In an electrolysis process, alumina, $Al_2O_3$, is dissolved in a bath of molten cryolite, $Na_3AlF_6$, aluminium fluoride, $AlF_3$ is used to reduce the melting point of liquid bath, which includes $Caf_2$, $Al_2O_3$ and Cryolite. The mixture is subjected to an electrolysis process in electrolysis cells (pots) connected in series, and liquid aluminium is produced at the cathodes. The carbon anodes are oxidized and bubble away as carbon dioxide. The chemical reaction as a whole is represented by the chemical equation given below:

$$2Al_2O_3+3C \rightarrow 4Al+3CO_2$$

The liquid aluminium product settles at the bottom of the bath, as molten aluminium is heavier than cryolite. The molten aluminium is periodically tapped from the bottom. At the top side of the bath cryolite forms a solid crust. This solid crust is broken by punching it with crust breakers. Gas evolved in the process escapes from holes formed in the broken crust. These holes also facilitate charging of fresh ore to the bath in the pot. While operating a set of electrolyzing pots connected in series, it many times happens that all the pots can not be put on line simultaneously. Some of the pots may be kept isolated out of the circuit while others in the line are running. The isolated pots are taken on line after they are made ready for running (for example completion of the maintenance work on them).

The present disclosure is related to taking the off line pots online while the pot line is running. Background art is described in the light of the above information with reference to figures, are briefly described below. Though all the figures are described in the section "Brief description of figures" the figures relevant to the background art only are described here again for the sake of convenience to the reader.

DESCRIPTION OF FIGURES RELEVANT TO PRIOR ART

FIG. 1. shows a front sectional side view of an aluminium reduction cell (pot).

FIG. 2. shows a top view of an arrangement of pots connected in series.

FIG. 3: shows right hand view of pots in series showing three of the total pots, the pots being shown one above the other for the sake of clarity of description.

FIG. 6*a:* shows front view of a shorted joint in a non running pot.

Referring to FIG. 1, pot assembly (I) is mounted on a civil column (24) having its steel rib plates (2) resting on an insulating material (1) provided on the civil column (24). This arrangement isolates the pot (I1) electrically from ground to avoid possible current leakage to the ground.

A pot shell assembly (3) comprises a pot shell (23) with the pot shell (23) being provided with a side pot cover (20), an end pot cover (21) for ease of maintenance and a corner pot cover (22) for controlling the emissions from the pot and for proper thermal balance.

Pot shell (23) is provided with a pot lining material like Calcium Silicate Bricks (4), Insulating Bricks (5), Dry Impervious material (6), castable (7), with the castable being a high strength refractory material used as a paste to seal all the side insulating bricks. Silicon Carbide bricks (11) and side carbon bricks (10). Cathode blocks (8) are placed over the dry impervious material (6).

A plurality of risers (14) is provided along the side of the pot. Risers (14) are welded to an anode bus bar (15) and anode assemblies (13) are clamped to the anode bus bar (15) by anode clamps (19). Carbon anode blocks (12) provided at a bottom end of the anode assemblies (13) are dipped into the bath. An anode jack (17) is provided on top of the pot to support the anode bus bar (15) provided on both sides of the pot. Current is passed to the pot (I) through these anodes. Alumina is continuously fed into the pot by an alumina hopper (16) provided above the bath surface. As the alumina slowly dissolves, primary negative complex ions are formed in the bath. The ions eventually reach the anode surface and react with the carbon anode blocks (12) forming carbon dioxide. Positive ions reach the cathode forming aluminium. Aluminium being heavier than the bath, settles down over the cathode. Metal is tapped at regular intervals from the pot. A solid crust of flux is formed on the top of the bath in the process. A crust breaking device (18) is provided to break the crust to form hole so that alumina can be continuously fed to the bath. The gases evolved in the process are also allowed to escape through the holes punched by the crust breaking device (18). Electrical current passed through the pots is typically in the range of 300 to 350 kA Turning now to FIG. 2, the layout of the pots, in a top view, may be seen. The plurality of pots is placed in row similar to those shown in the figure. The figure shows three consecutive pots, Pot A, Pot B and Pot C in a line, which is part of the total pot line. A few elements, for example, pot shell (23), risers (14), anode bus bar (15), are shown for understanding of the layout. Short circuit bus bars (21 ) are provided for short circuiting of the risers (14) of one pot to the risers (14) of the next pot to isolate the non running pot from the rest of the pots electrically. A solid arrow (25) shows the direction of current in the pot line.

Referring to FIG. 3, the same three consecutive pots (Pot A, Pot B and Pot C) shown in the layout of FIG. 2 may be seen, but in their side views for ease of explanation. Pot A and Pot C shown in this figure are the on line or running pots and Pot B is a non running pot in the pot line. Direction of current flow is from Pot C to Pot B to Pot A. In a normal case, i.e. if all the pots are on line, the current would have been flowing from cathode bus bar (31) of Pot C to anode bus bar ( 15) of Pot B and after passing through the charge in Pot B to cathode bus bar (31), it would have been passing to anode bus bar (15) of Pot A.

In case of the non running pot (Pot B in this case) the risers (14) are connected to the cathode bus bar (31) of the pot by means of a short circuit bus bar (21). The cathode bus bar (31) is connected to riser of the next Pot A (not shown in the drawing). Thus, the current coming from first running pot (Pot C) directly passes from the risers of the non running Pot B to the risers (14) of the next running pot (Pot A). In this case, the top end of the short circuit bus bar (21) is fastened to the riser (14) to form short circuit joint (II) which is shown in detail in FIG. 6*a*. The solid arrows in FIG. 6*a* show the direction of current. Short circuit bus bars (21) are fastened to the riser (14) by means of fasteners (61) provided for same.

In case of running pots, Pot C and Pot A in this description, the short circuit bus bars (21) are isolated from the risers (14) by inserting insulating insert plates (33) between the risers (14) and short circuit bus bars (21).

When the non running pot, Pot B, as described above is to be taken on line, the current should flow through the riser (14) of Pot B to the pot and not through the shorted bus bars (21). Hence, insulation insert plates (33) are introduced between the riser (14) and the shorted bus bars (21) to make the current flow through the Pot B. To introduce the insulation plates, the shorted joint (II) should be opened. If the shorted joint (II) is opened while the current is flowing through it, heavy sparking occurs. Hence current is brought down to 0 kA and then the shorted joint fasteners are released and a gap is made at the joint. After a sufficient gap is made, the insulation insert plates (33) are inserted on both sides of each riser and then the fasteners (61) are tightened as shown in FIG. 6*a*.

During a power on of the pot, the current is reduced to 0 kA at a rate in the range 12 kA/min to 16 kA/min, due to restrictions in the power plant. While increasing the current to a working range of 300 kA to 350 kA, preferably 320 kA, it is raised in steps of 0-80-160-240-280-320 kA. This step rise is required as a sudden increase in the current will increase the voltage across the individual pot which can affect or even cause damage to the plant. The permissible range of the voltage across an individual pot is 4.5 V to 5.5 V. If it is found that the voltage is rising beyond the target value, an increase in current is kept on hold for some time till the voltage reduces as desired. Due to this reason, it takes around 20 to 25 minutes in reduction and increase of current between 0 kA and 320 kA. Adding to this, the time required for unfastening of the shorted bus bars (21) from risers (14) the total time that is lost is about 30 to 40 minutes.

Considering the scale of production, this loss of the production time has a high impact on the functional economy of the plant and there is an ominous need felt by the industry to reduce the same to a minimum for increasing productivity.

In addition to loss of production time, there are other disadvantages and/or limitations of the prior art. For example, disturbances to the running operating pots due to reduction of current to zero and again increasing to full value also are disadvantageous. There is also an adverse impact on the power plant operation as well as on its equipment and production losses may be experienced due to a decrease in line amperage during power on of pots, as well as production time lost in this process.

SUMMARY

A method of taking inoperative pot online using fuse in an aluminium manufacturing plant operating on electrolysis process is disclosed. The manufacturing plant comprises of plurality of electrolysis cells or pots connected in series. Some of the pots are kept off line during start up of the plant by shorting the risers of the non running pots to the cathode bus bar (31) by shorted joints (II). The method comprises, connecting fuse assemblies in parallel with the shorted joints; inserting insulating insert plates between the risers and the short circuit bus bars and securing the insulating insert plates to isolate the short circuit bus bars from the risers (14) such that the total rated current passes through the fuse assemblies. The fuse elements in the fuse assemblies melt within about 8 to 10 minutes, completely isolating the short circuit bus bars from the risers such that the risers now feed the current to the anode assemblies of the non running pot. Feeding of charge to the non running pot is the started, thus taking the non running pot on line.

DETAILED DESCRIPTION

The problems and shortcomings associated with prior art techniques and approaches are overcome by the present disclosure as described below in an preferred embodiment. However, it is understood that the embodiment is illustrated in the accompanying drawings, through out which like reference letters indicate corresponding parts in the various figures.

Figure 3:
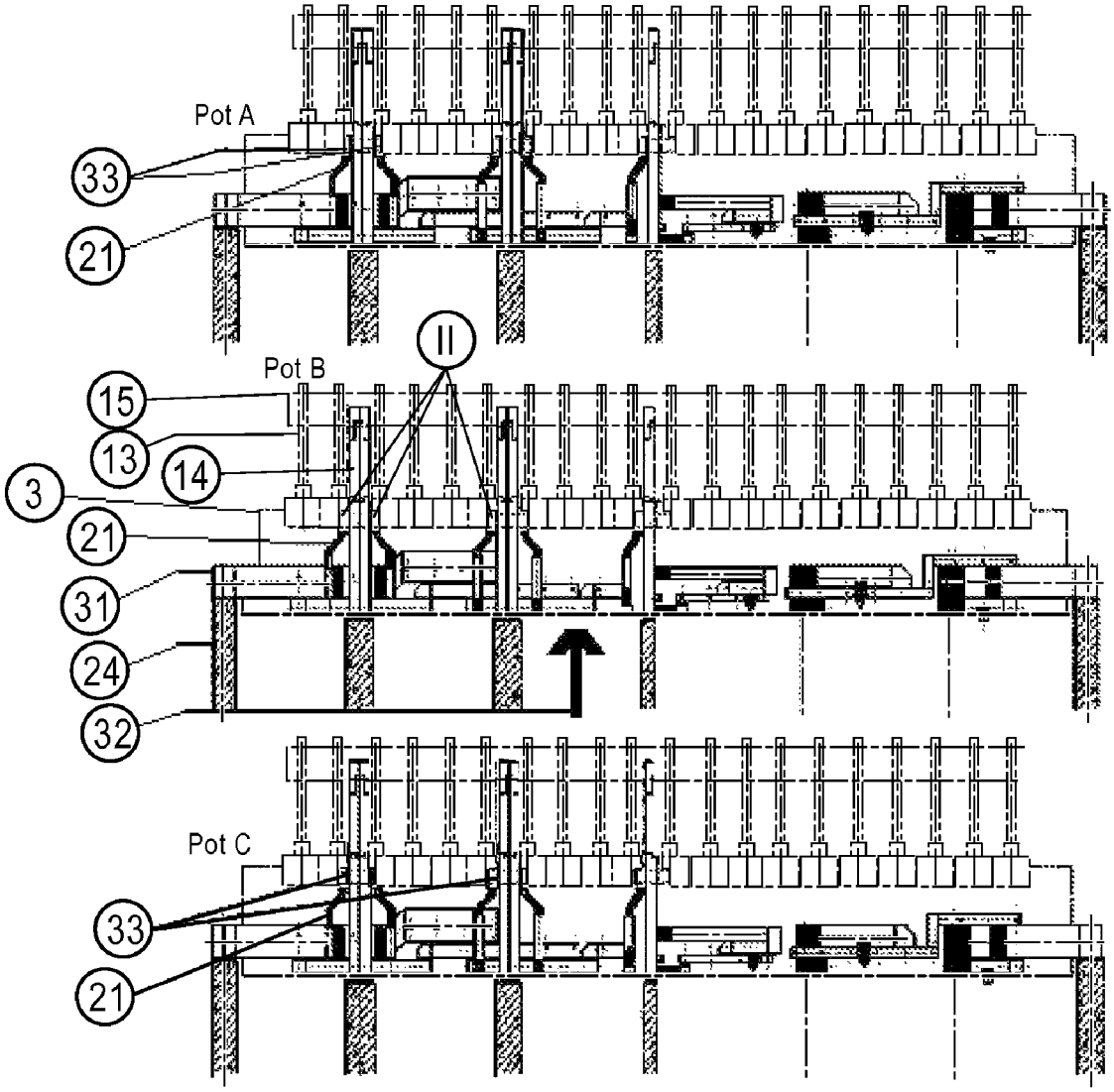
FIG. 3 is a right hand view of pots in series, with the pots being shown one above the other for clarity of understanding (Pot B is shown as a non running pot).

When the manufacturing process is started, the condition of the three representative pots (e.g., Pot A, Pot B and Pot C) are shown in FIG. 3.

Figure 1:
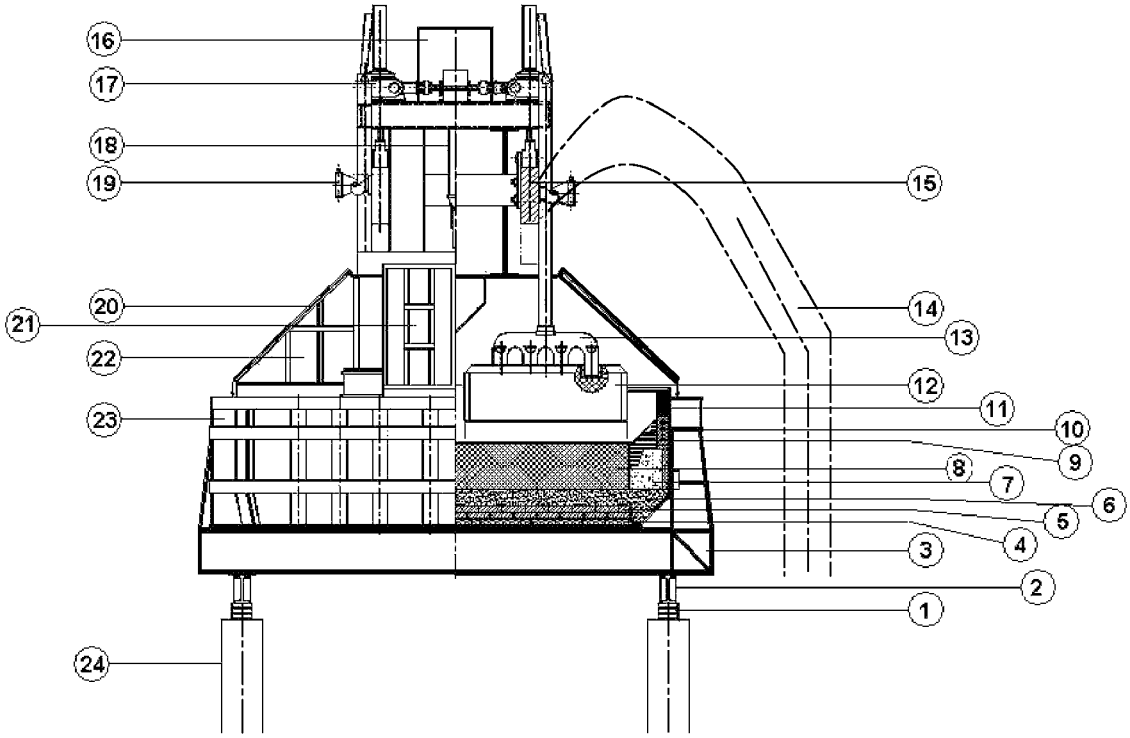
FIG. 1 is a sectional front view of an aluminium reduction cell.
Figure 2:
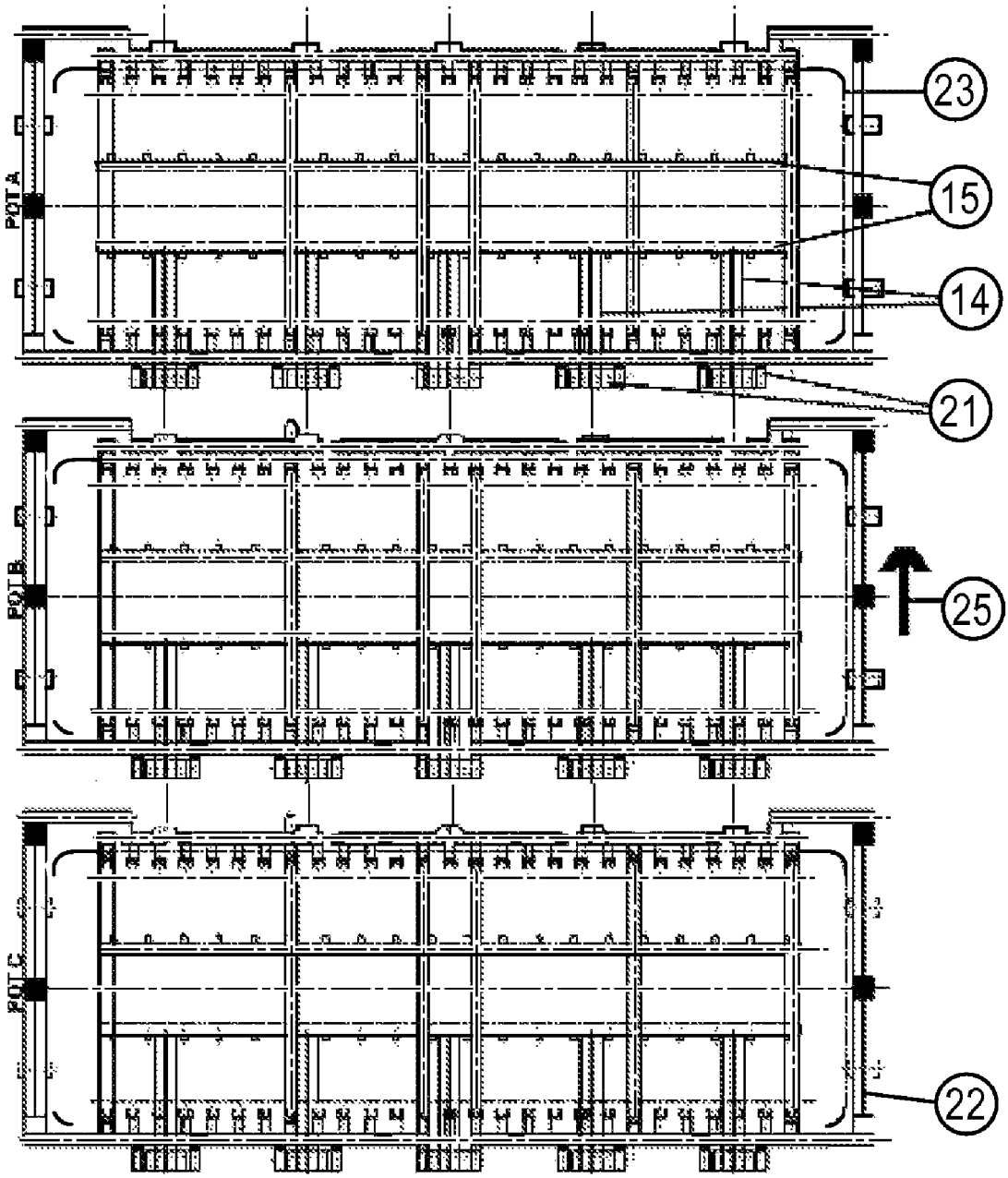
FIG. 2 is a top view of a layout arrangement of pots in series.

Out of these three pots, Pot A and Pot C are running pots and Pot B is a non running pot when the manufacturing process is started. In the case of Pot A and Pot C, the shorted joints (II) are kept in an open condition by inserting the insulating insert plates (33) between the short circuit bus bars (21) and risers (14). Thus, the current in the risers (14) of these pots is fed to the anode assemblies (13) and passed through the carbon anode blocks (12) for electrolysis as shown in the FIG. 1. Hence, these pots (Pot A and Pot C) are on line.

At the same time, in the case of Pot B, the risers (14) are directly in electrical contact due to the shorted joints (II) with short circuit bus bars (21). The short circuit bus bars (21) are fastened to the risers (14) with out inserting the insulating insert plates (33) between them. The current in the risers (14) of this pot is being diverted to the risers (14) of the next pot (Pot A) through cathode bus bars (31).

An exemplary embodiment of a method of taking the non running pot on line is described below, with particular reference to FIG. 4.

As an initial matter, it is noted that it is not necessary to reduce the current through the running pots in the method described herein. Alternatively, however, in some cases the current may be reduced to the value equal to 80% to 85% of the full load current which does not cause any disturbance to the running pots, i.e. the pots which are already on line. The initially non running pot that is taken on line is also smoothly put on line using the method described below.

Figure 6A:
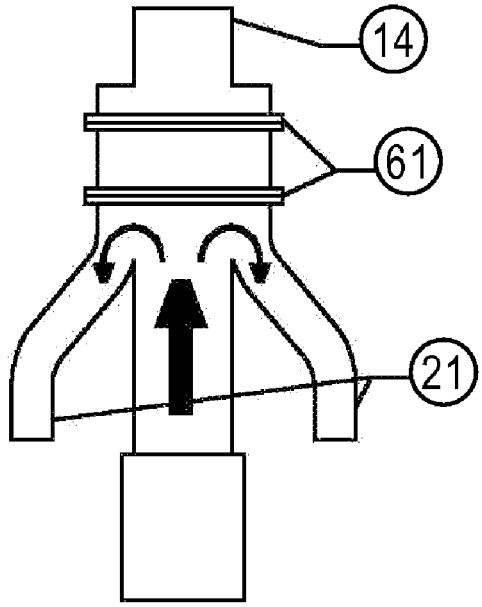
FIG. 6*a* is a detailed isolated view of a shorted joint in a non running pot.
Figure 6B:
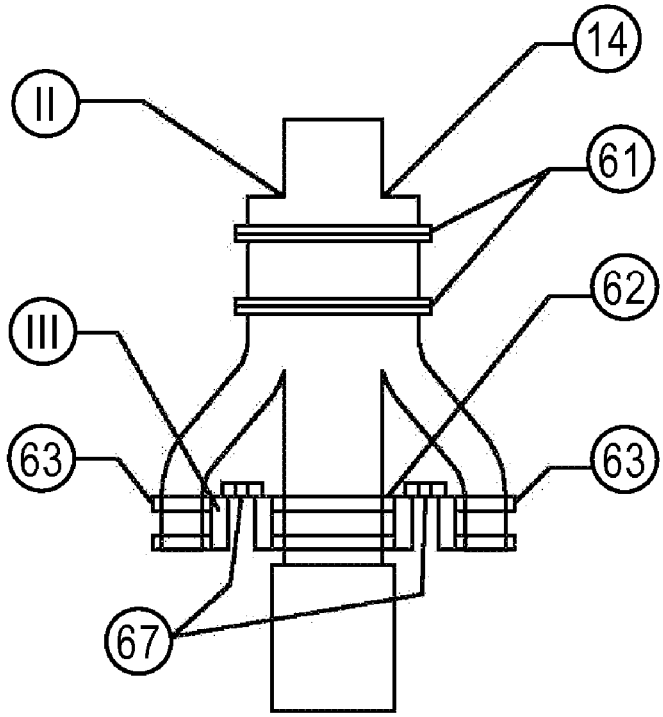
FIG. 6*b* is a detailed isolated view of shorted joint fitted with a fuse assembly.
Figure 6C:
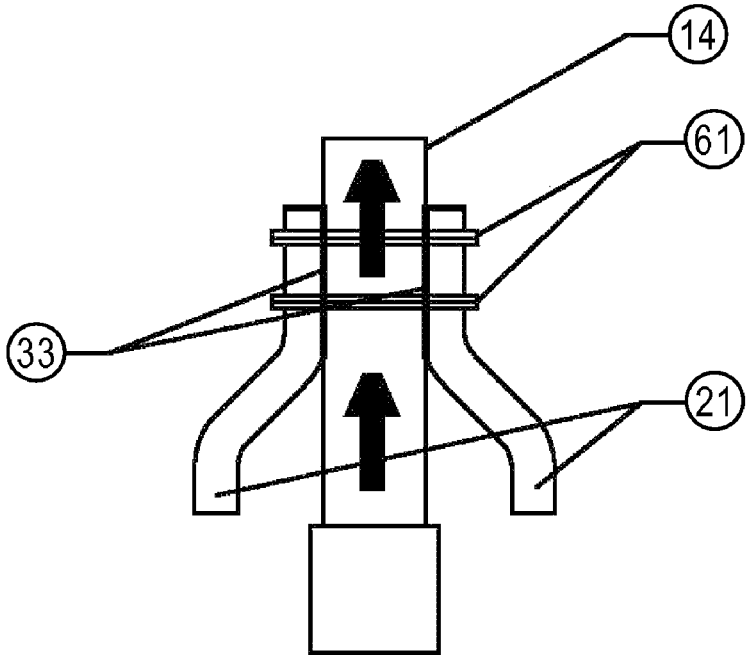
FIG. 6*c* is a detailed isolated view of the shorted joint after inserting insulation insert plates to open the shorted joint.

First, fuse assemblies are fitted in parallel to the shorted joints (II) of the non running pot (Pot B) between risers (14) and short circuit bus bars (21). The shorted joint fitted with a fuse in parallel (IV) is shown in detail in FIG. 6*b*. As may be seen, one end of each of the fuse assemblies (III) is fitted to the riser (14) by a clamp (67) that can hold two fuses, one on either side of the riser (14). The other ends of the fuse assemblies (III) are fitted to short circuit bus bars (21) on either side of the riser (14) by clamps (63).

Figure 7:
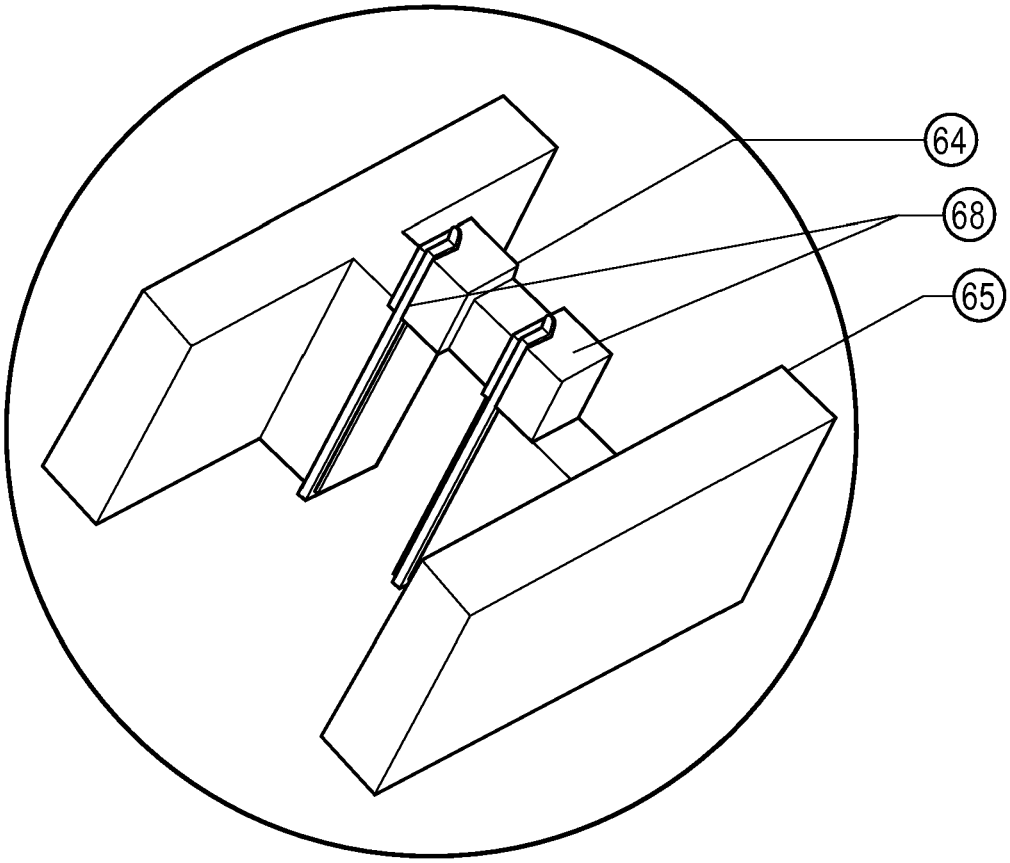
FIG. 7 illustrates a detailed isolated view of the fuse assembly

The fuse assembly (III) is shown in detail separately in FIG. 7. At both ends of the fuse assembly (III), fuse blocks (65) are provided. The fuse blocks are metallic blocks provided to ensure proper electrical contact of the fuse assembly with a riser (14) on one side and a short circuit bus bar (21) on the other side when the fuse is clamped by clamps (67) and (63), respectively. Fuse element (67) is clamped between the two fuse blocks (65) by clamps (68), thereby forming the fuse assembly.

The material of the fuse element (67) is approximately 99.7% pure aluminium. Hence, fuse element (67) melts at about 660° C. at its melting temperature without passing through a semi solid phase to avoid sparking when the fuse melts. The cross section of the fuse element (67) is designed in such a way that the fuse element (67) heats up when rated current of the short circuit bus bar (21) is passed through it and reaches the melting temperature of the fuse element (67), in about 8 to 10 minutes.

Figure 4:
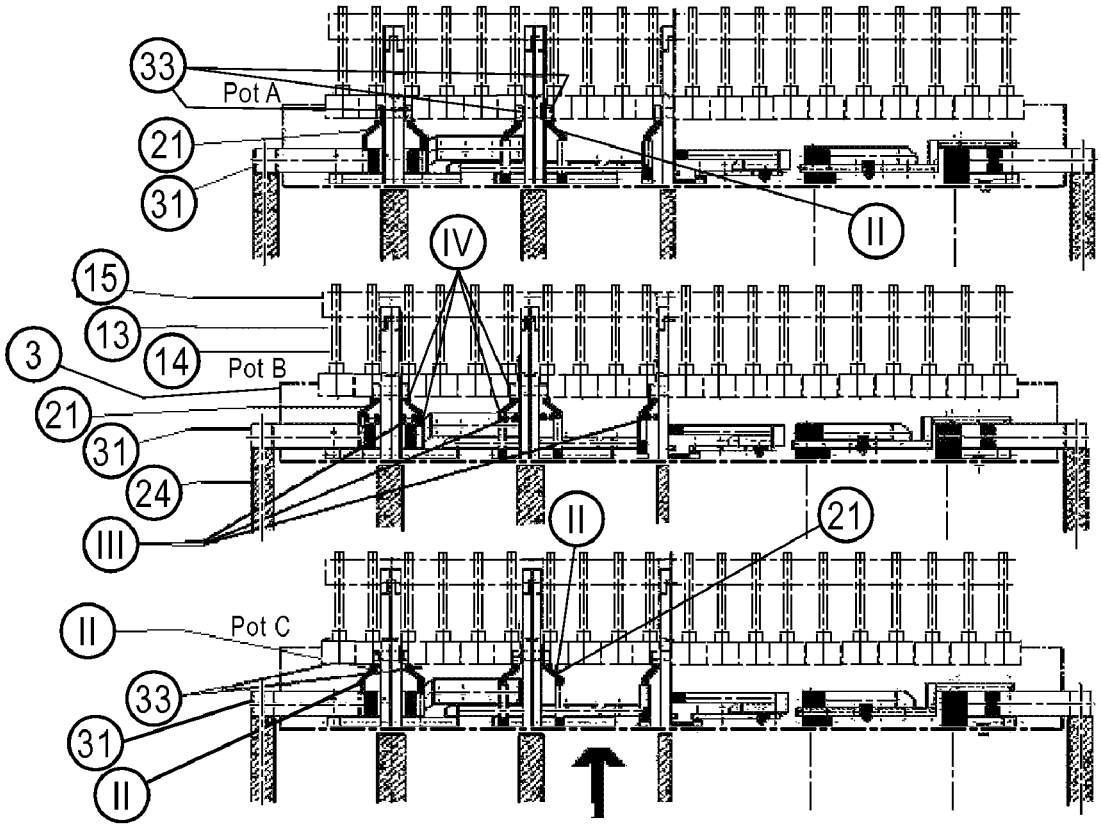
FIG. 4 is an arrangement of pots in series with Pot B is fitted with a fuse assembly.

After the fuse assemblies (III) are fitted in parallel to the shorted joints (II) (as shown by (IV) in FIG. 4) as described above, the shorted joints (II) are opened by releasing the fasteners (61). As the fuse assemblies now take up full rated current passing through the short circuit bus bars (21) there is no sparking while opening the shorted joints (II) and the operation may be carried out with out reducing the current.

Next, the insulating insert plates (33) are inserted between the risers (14) and short circuit bus bars (21) and fastened again. The joint between the short circuit bus bars (21) and the risers (14) is thus opened and full rated current of the short circuit bus bars (21) starts flowing through the fuse assemblies (III) at the joint (IV) connected already in parallel with the short circuit joints (II).

Figure 5:
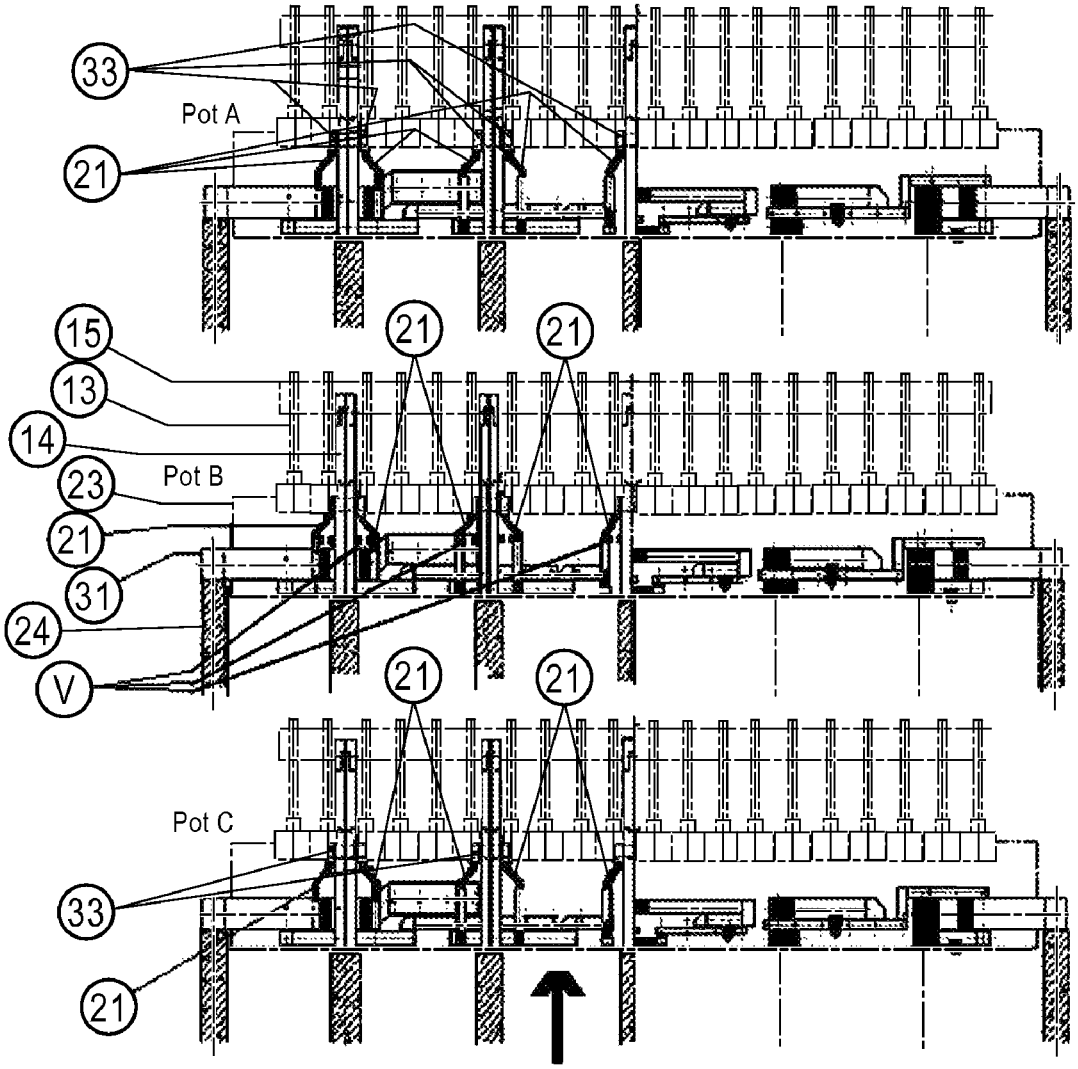
FIG. 5 is an arrangement of pots in series with Pot B online with the fuses in a blown condition.
Figure 6D:
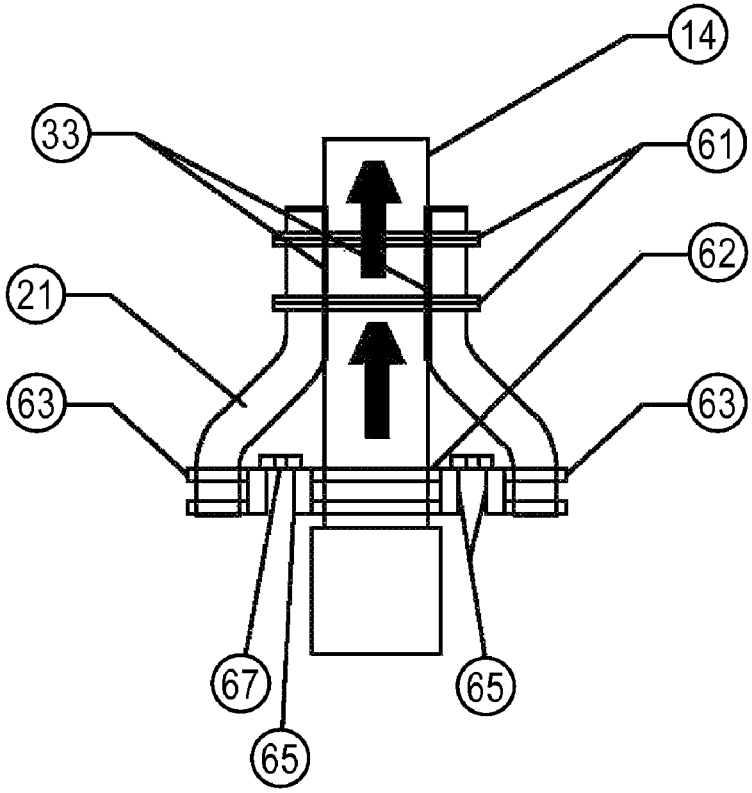
FIG. 6*d* is a detailed isolated view of the shorted joint after inserting the insulation insert plates to open the shorted joint and the fuse is in a molten condition (blown).

The fuse element (67) next starts getting heated up at the short circuit bus bar (21) due to current passing through it and melts on reaching its melting temperature without passing through a solidus (semi solid) phase, thereby opening the electrical connection between the short circuit bus bar (21) and riser (14). The riser (14) of the initially non running pot (Pot B in this description) in this condition is isolated from the riser (14) of the next pot (Pot A) and previous pot (Pot C). This condition is depicted by joint (V) in FIG. 5. Joint (V) is shown in isolated detail in FIG. 6*d*. FIG. 6*d* shows insulating insert plates (33) between the riser (14) and short circuit bus bars (21) fastened with fasteners (61) and fuse elements (67) molten (disappeared from the fuse assembly hence shown by ghost lines in FIG. 6*d*). The current through the previously non running pot (Pot B) now passes from riser (14) to the anode assembly (13) through anode bus bar (15) and the pot is on line.

Finally, now feeding of the charge to the pot (Pot B), which is recently taken on line, is started and the production resumes.

According to the method described above, when a non running pot is to be taken on line, first fuses are introduced between the risers and the shorted bus bars in parallel with the shorted joint between the riser and the shorted bus bar. This forms a parallel path for the current which is being passed through the shorted joint. The fuses are designed to take the full load current that passes through the shorted joint. In this condition the shorted joint can be safely opened by releasing the fasteners with out any sparking while releasing the same.

Insulating insert plates are then inserted between the risers and the shorted bus bars to isolate or open the shorted joint and the fasteners are tightened. Now the shorted joint is in open condition and the load current is passing through the fuse to the risers of the next pot.

Each fuse comprises a fuse block fuse element clamped between the two fuse blocks and three clamps. The fuse block is clamped to the riser on one side by first clamp and the other end of the fuse block is clamped to the shorted bus bar by second clamp. The material and cross section of the fuse element is selected in such a manner that the fuse heats up while the load current passes through it and temperature of the fuse goes on rising. The material of the fuse material of fuse is approximately 99.7% pure aluminium and it melts when the temperature reaches about 660 deg C.

At rated current the fuse temperature reaches the melting temperature of the fuse within about 8 to 10 minutes. The fuse thus suddenly melts with out causing any sparking and the shorted bus bar is completely isolated from the riser of the off line pot. At this stage there is no passage of current from riser of the first pot to the riser of the next pot and the risers of the previously off line pot start feeding the current to the electrodes of the pot taking the off line pot on line. The total process takes less than 10 minutes to complete as compared to the 30 to 40 minutes required in case of the prior art method. Further, in the method of the present disclosure, it is not necessary to reduce the current in the total line to zero which affects the performance of the running pots.

The problems and shortcomings associated with prior art techniques and approaches are overcome by the present disclosure described in connection with the present embodiment.

Detailed descriptions of the preferred embodiment are provided herein; however, it is to be understood that the present disclosure may be embodied in various forms. Therefore, specific details disclosed herein are not to be interpreted as limiting, but rather as a basis for the claims and as a representative basis for teaching one skilled in the art to employ the present disclosure in virtually any appropriately detailed system, structure or matter.

The embodiments of the invention as described above and the methods disclosed herein will suggest further modification and alterations to those skilled in the art. Such further modifications and alterations may be made without departing from the spirit and scope of the invention; which is defined by the scope of the following claims.

We claim:

1. A method of taking an inoperative pot online using a fuse in an aluminium manufacturing plant operating on an electrolysis process wherein the manufacturing plant comprises of plurality of electrolysis pots, the pots being provided with risers that are electrically connected to anodes, and cathodes that are electrically connected to cathode bus bars; wherein the anodes and cathodes are submerged in a bath formed by electrolyte and ore, and voltage across an individual pot is within the range of approximately 4.2V to 4.3V; and electric current in the range of about 320 kA to 324 kA is passed through the pots through the risers, the current passing through the bath to the cathodes, the electrodes of the plurality of pots being electrically connected in series, with some of the pots being kept off line during start up of the manufacturing plant by shorting the risers of the non running pots to the cathode bus bar by shorted joints (II), thus bypassing the current through the non running pot and connecting directly the adjacent pots on either side of the non running pot, the method comprising following actions being carried out on the non running pot:

a. fitting fuse assemblies in parallel with the shorted joints to connect the risers to the short circuit bus bars on both sides through the fuse assemblies;

b. opening the shorted joints;

c. inserting insulating insert plates between the risers and the short circuit bus bars and securing the short circuit bus bars in place, thereby isolating the short circuit bus bars from risers;

d. passing a full load of current of the short circuit bus bars through the fuse assemblies;

e. melting the fuse elements in the fuse assemblies within about 8 to 10 minutes at the rated current in the shorted bus bars, thereby isolating the short circuit bus bars completely from the risers;

f. feeding current from the risers to the anode assemblies of the pot through the anode bus bars; and g. feeding of the charge to the bath in the pot is started, thus taking the non running pot on line.

2. The method of taking an inoperative pot online using fuse in an aluminium manufacturing plant operating on electrolysis process as claimed in claim 1, wherein the fuse assembly further comprises:

a pair of metallic fuse blocks, one of the fuse blocks provided at each end of the fuse assembly, a fuse element clamped between the fuse blocks;

wherein the material of the fuse element is approximately 99.7% pure aluminium and the cross section of the fuse element is designed so as to heat up the fuse element in about 8 to 10 minutes to its melting temperature of about 660° C., while carrying the same current that is passing through the short circuit bus bars.

3. The method of taking an inoperative pot online using fuse in an aluminium manufacturing plant operating on electrolysis process as claimed in claim 1, wherein the current is reduced in the range of about 80% to 65% of the full load current before starting the process of taking non running pot on line.

4. The method of taking an inoperative pot online using fuse in an aluminium metal manufacturing plant operating on an electrolysis process as claimed in claim 1, wherein the step of fitting the fuse assemblies in parallel with the shorted joints includes clamping the risers to the short circuit bus bars.

5. The method of taking inoperative pot online using fuse in an aluminium metal manufacturing plant operating on an electrolysis process as claimed in claim 1, wherein the step of opening the shorted joints includes selectively releasing fasteners.

6. The method of taking inoperative pot online using fuse in an aluminium metal manufacturing plant operating on an electrolysis process as claimed in claim 1, wherein the step of securing the short circuit bus bars includes tightening fasteners.

* * * * *